US008307601B2

(12) United States Patent
Bonelli

(10) Patent No.: US 8,307,601 B2
(45) Date of Patent: Nov. 13, 2012

(54) PREFABRICATED WALL ELEMENT

(75) Inventor: Giuseppe Bonelli, Cuneo (IT)

(73) Assignee: B.B. Bonelli Building S.r.l., Savigliano, Cuneo (IT)

( * ) Notice: Subject to any disclaimer, the term of this patent is extended or adjusted under 35 U.S.C. 154(b) by 209 days.

(21) Appl. No.: 12/842,370

(22) Filed: Jul. 23, 2010

(65) Prior Publication Data

US 2011/0173919 A1 Jul. 21, 2011

(30) Foreign Application Priority Data

Jul. 24, 2009 (IT) ..... MI2009A1317

(51) Int. Cl.
*E04B 2/00* (2006.01)

(52) U.S. Cl. ..... 52/587.1; 52/583.1; 52/278; 403/305

(58) Field of Classification Search ..... 52/583.1, 52/587.1, 578, 274, 278, 284, 699, 122.1, 52/125.1, 125.4, 125.5; 403/305, 306, 307
See application file for complete search history.

(56) References Cited

U.S. PATENT DOCUMENTS

| | | | | |
|---|---|---|---|---|
| 1,975,235 | A * | 10/1934 | Lowell | 52/125.5 |
| 2,280,080 | A * | 4/1942 | Predan | 52/99 |
| 2,989,155 | A * | 6/1961 | Ocker | 52/585.1 |
| 3,332,182 | A * | 7/1967 | Mark | 52/127.12 |
| 4,030,262 | A * | 6/1977 | Dean | 52/587.1 |
| 4,069,629 | A * | 1/1978 | Piazza | 52/125.5 |
| 4,304,431 | A * | 12/1981 | Walston | 294/89 |
| 4,320,606 | A * | 3/1982 | GangaRao | 52/125.5 |
| 5,216,860 | A * | 6/1993 | Thomson et al. | 52/259 |
| 5,806,273 | A * | 9/1998 | Kaminski et al. | 52/586.1 |
| 5,829,207 | A * | 11/1998 | Mackay Sim et al. | 52/125.4 |
| 5,862,639 | A * | 1/1999 | Abou-Rached | 52/223.6 |
| 5,865,001 | A * | 2/1999 | Martin et al. | 52/309.12 |
| 5,913,793 | A * | 6/1999 | Hills | 52/741.13 |
| 5,987,827 | A * | 11/1999 | Lord | 52/274 |
| 6,003,278 | A * | 12/1999 | Weaver et al. | 52/414 |
| 6,058,672 | A * | 5/2000 | McClellan | 52/587.1 |
| 6,065,263 | A * | 5/2000 | Taguchi | 52/583.1 |
| 6,086,288 | A * | 7/2000 | Ruel et al. | 405/262 |
| 6,119,431 | A * | 9/2000 | Wakai | 52/745.2 |
| 6,223,480 | B1 * | 5/2001 | Khoo | 52/79.9 |
| 6,233,891 | B1 * | 5/2001 | De Cosse | 52/309.12 |
| 6,327,829 | B1 * | 12/2001 | Taguchi | 52/583.1 |
| 6,463,702 | B1 * | 10/2002 | Weaver et al. | 52/79.1 |
| 6,568,730 | B1 * | 5/2003 | Paterson | 294/89 |
| 6,622,442 | B2 * | 9/2003 | Kwon | 52/259 |
| 6,647,678 | B1 * | 11/2003 | Zambelli et al. | 52/252 |
| 6,694,680 | B2 * | 2/2004 | Zambelli et al. | 52/125.2 |

(Continued)

FOREIGN PATENT DOCUMENTS

DE 814651 9/1951

(Continued)

*Primary Examiner* — William Gilbert
*Assistant Examiner* — James Ference
(74) *Attorney, Agent, or Firm* — Shoemaker and Mattare

(57) ABSTRACT

A prefabricated wall element comprises a wood-cement plate-like body, a reinforcement embedded in the body and one or more plate-bracket units with a connecting plate rigidly connected to one or more anchoring brackets embedded in the plate-like body and engaged to the reinforcement, in which the plate-like body together with a rear surface of the connecting plate facing inwards the plate-like body define an assembling seat with an access opening lateral to the connecting plate.

15 Claims, 6 Drawing Sheets

U.S. PATENT DOCUMENTS

| | | | | |
|---|---|---|---|---|
| 6,789,776 | B1 * | 9/2004 | Gavin | 249/61 |
| 6,793,436 | B1 * | 9/2004 | Ruel et al. | 403/316 |
| 6,898,908 | B2 * | 5/2005 | Messenger et al. | 52/268 |
| 6,976,344 | B2 * | 12/2005 | Sanger | 52/741.1 |
| 7,017,316 | B2 * | 3/2006 | DiLorenzo | 52/414 |
| 7,134,805 | B2 * | 11/2006 | Yee | 404/50 |
| 7,523,591 | B2 * | 4/2009 | Di Lorenzo | 52/414 |
| 7,530,203 | B1 * | 5/2009 | Hare et al. | 52/251 |
| 7,574,840 | B1 * | 8/2009 | Fyfe | 52/582.1 |
| 7,677,832 | B2 * | 3/2010 | Yee | 404/40 |
| 7,857,540 | B2 * | 12/2010 | Ruel et al. | 403/208 |
| 7,975,444 | B2 * | 7/2011 | Holdsworth et al. | 52/223.7 |
| 2002/0020131 | A1 * | 2/2002 | Hongyo et al. | 52/582.1 |
| 2003/0140575 | A1 * | 7/2003 | Sanftleben et al. | 52/125.4 |
| 2003/0167716 | A1 * | 9/2003 | Messenger et al. | 52/309.12 |
| 2004/0012216 | A1 * | 1/2004 | Paterson | 294/89 |
| 2004/0065034 | A1 * | 4/2004 | Messenger et al. | 52/309.11 |
| 2004/0149951 | A1 * | 8/2004 | Gethmann | 251/291 |
| 2005/0220539 | A1 * | 10/2005 | Yee | 404/40 |
| 2005/0258572 | A1 * | 11/2005 | Messenger et al. | 264/333 |
| 2008/0010932 | A1 * | 1/2008 | Elliott et al. | 52/404.1 |
| 2008/0104909 | A1 * | 5/2008 | Wallin | 52/293.1 |
| 2010/0058677 | A1 * | 3/2010 | Arteon | 52/122.1 |

FOREIGN PATENT DOCUMENTS

| | | |
|---|---|---|
| FR | 1528736 | 6/1968 |
| WO | 03/006758 | 1/2003 |

* cited by examiner

PREFABRICATED WALL ELEMENT

A wood-cement prefabricated wall element with means for mutual positioning and connection with other wall elements, ceilings and floors forms an object of the present invention.

Reinforced concrete prefabricated wall elements, in which some ends of the reinforcement rids project from the edges of the wall element so as to be welded to corresponding projecting ends from other wall elements are known.

Reinforced concrete prefabricated wall elements with steel connecting plates anchored into the cement of the wall element and provided with holes for receiving pins or bolts for connection to other wall elements or to ceilings or floors are also known.

However, the prior art solutions require a high resistance of the reinforced concrete to prevent local damages to the wall element due to loads transmitted by the ends of the reinforcement or by the connecting plates when laying the wall element. Thus, the prior art solutions are difficult to use with cement-wood prefabricated wall elements, in which a substantial portion of the inert material is constituted by wood fragments, and which has a resistance lower than that of concrete or conventional reinforced concrete.

A further disadvantage of the prior art wall elements consists in the difficult access to the connecting plates with the aim of assembling the connecting members, for example pins or bolts.

A further disadvantage of the prior art wall elements consists in the visibility of the connecting plates with the wall mounted and in the need to cover the connecting plates, and thus the entire wall, by means of a layer of plaster or any other coating material.

SUMMARY OF THE INVENTION

Thus, the object of the present invention is that of proposing a prefabricated wall element having characteristics such to overcome the aforementioned drawbacks with reference to the prior art.

Such object is attained by means of a prefabricated wall element as described below.

BRIEF DESCRIPTION OF THE DRAWINGS

For a clearer understanding of the present invention and observing the advantages thereof, described hereinafter are some exemplifying non-limiting embodiments thereof, with reference to the attached figures, in which.

DETAILED DESCRIPTION OF THE PREFERRED EMBODIMENT(S)

Figure 1:
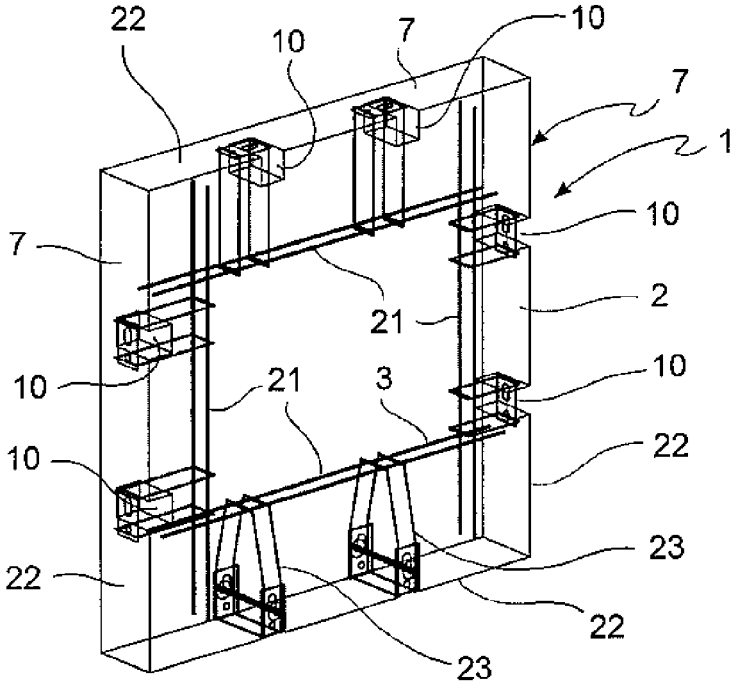
FIG. 1 is a transparent perspective view of a wall element according to an embodiment of the invention.
Figure 2:
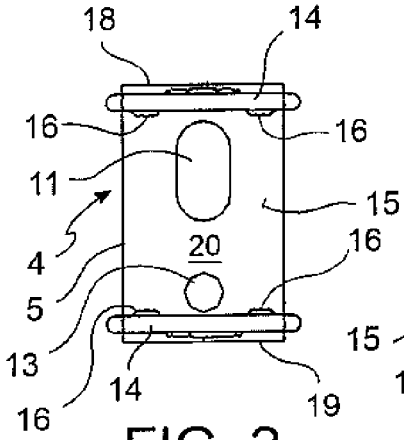
FIG. 2 is a front view of a plate-bracket unit of the wall element in FIG. 1.
Figure 3:
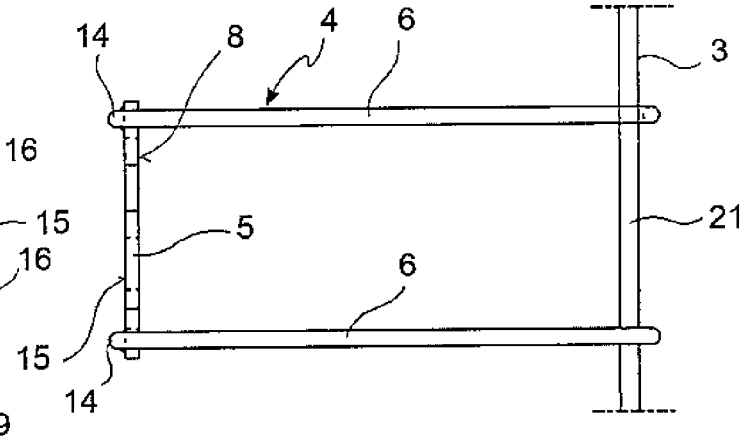
FIG. 3 is a lateral view of the plate-bracket unit of FIG. 2.
Figure 4:
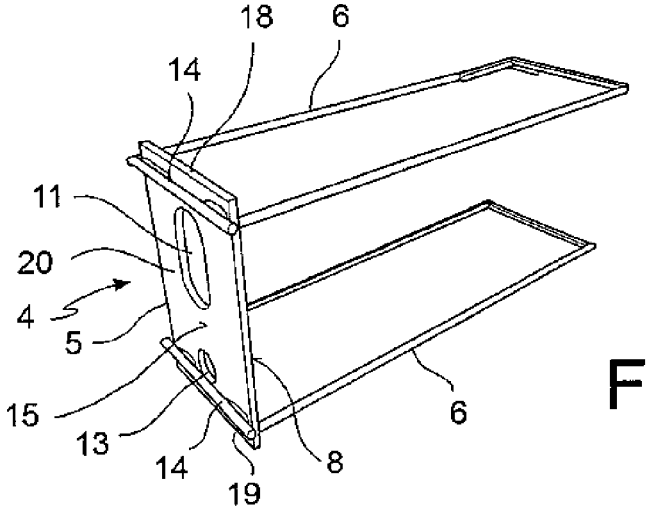
FIG. 4 is a perspective view of the plate-bracket unit of FIG. 2.

Referring to the figures, a prefabricated wall assembly is indicated in its entirety with reference number 1.

The assembly 1 comprises a cement-wood plate-like body 2, a metal reinforcement 3 embedded in the body 2, as well as means for positioning and connecting the wall assembly 1 with respect to further wall elements 1 and other structural elements, for example a ceiling or a floor.

The positioning and connection means comprise one or more plate-bracket units 4 with a connecting plate 5 rigidly connected to at least one, preferably at least two anchoring brackets 6, in which the connecting plate 5 is arranged in a connection surface 7 of the plate-like body 2 intended to face and adhere to a corresponding connection surface 7 of a further wall element 1 and the anchoring bracket/s 6 are embedded in the body 2 and engaged to the reinforcement 3. Furthermore, the plate-like body 2 together with a rear surface 8 of the connecting plate 5 facing inwards the plate-like body 2 define an assembling seat 9 (FIG. 5) with an access opening 10 lateral to the connecting plate 5 and to the connection surface 7.

The connecting plate 5 is preferably rectangular and comprises one or more connecting holes 11, advantageously in form of an eyelet and even more advantageously in form of a substantially elliptic eyelet, suitable to receive a connecting bolt and may comprise one or more further engagement openings 13 for the coupling of a hook for the transfer of the wall element 1 by means of a crane.

Figure 5:
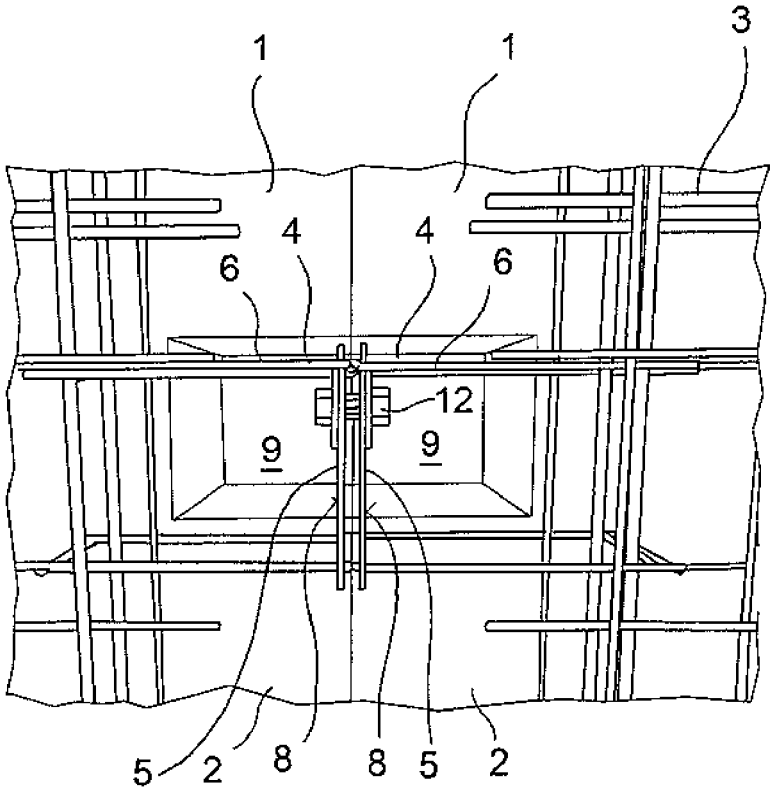
FIG. 5 is a transparent and enlarged view of a connection zone between two wall elements according to an embodiment.
Figure 6:
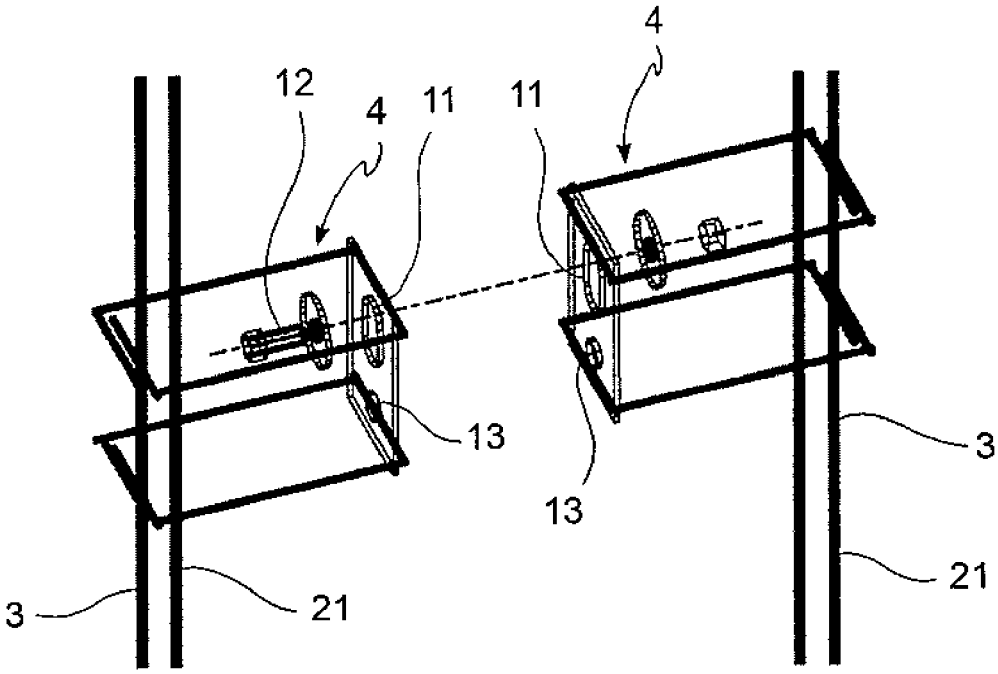
FIG. 6 is a perspective view of the connection zone in FIG. 5 with the wood-cement material removed.
Figure 7:
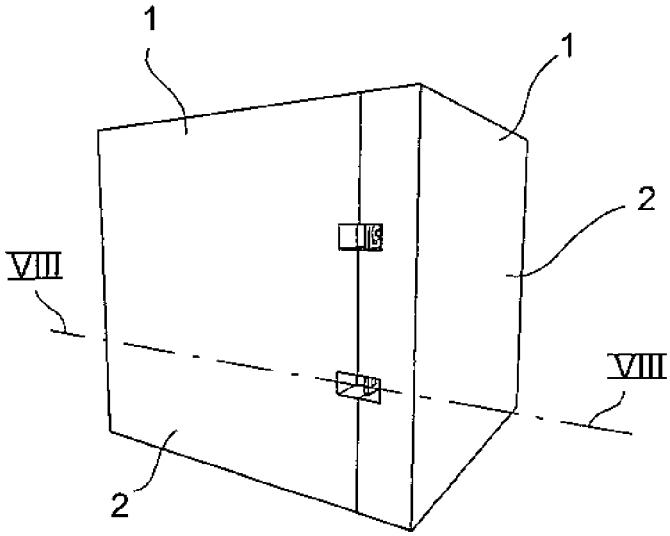
FIG. 7 is a perspective view of the connection zone (outer angle) between two wall elements according to an embodiment.
Figure 8:
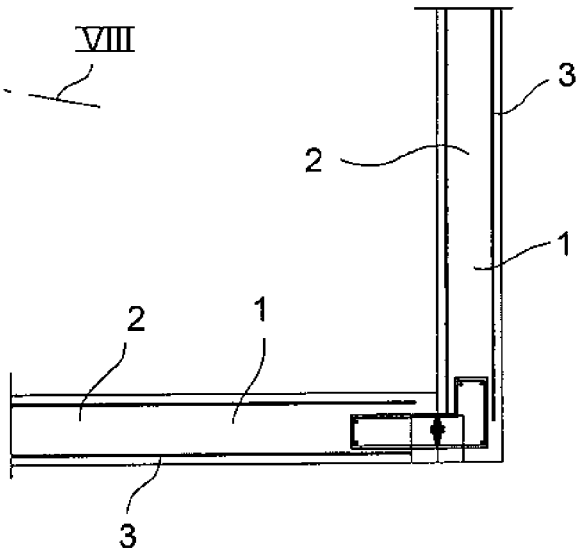
FIG. 8 is a sectional view according to plane VIII-VIII in FIG. 7.
Figure 9:
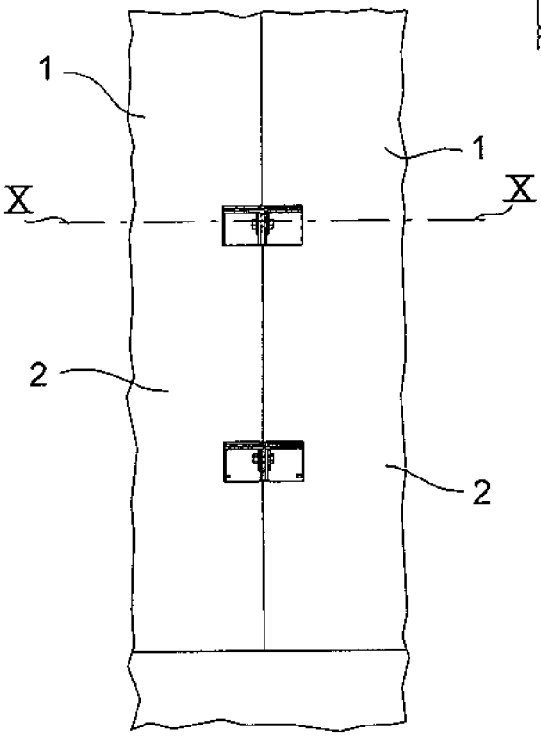
FIG. 9 is a perspective view of the connection zone (front) between two wall elements according to an embodiment.
Figure 10:
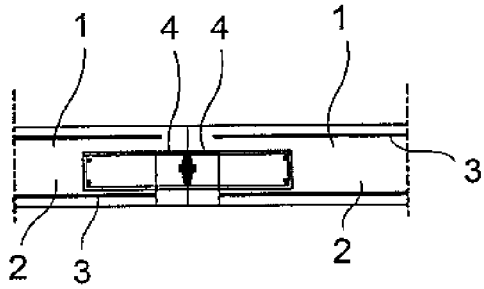
FIG. 10 is a sectional view according to plane X-X in FIG. 9.
Figure 11:
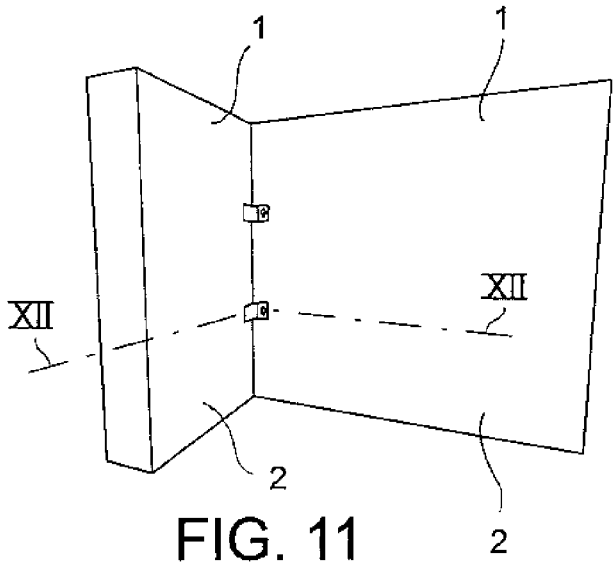
FIG. 11 is a perspective view of the connection zone (internal angle) between two wall elements according to an embodiment.
Figure 12:
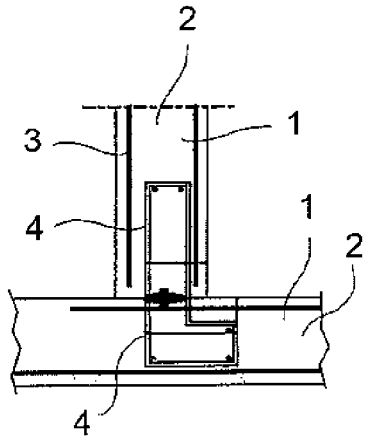
FIG. 12 is a sectional view according to plane XII-XII in FIG. 11.
Figure 13:
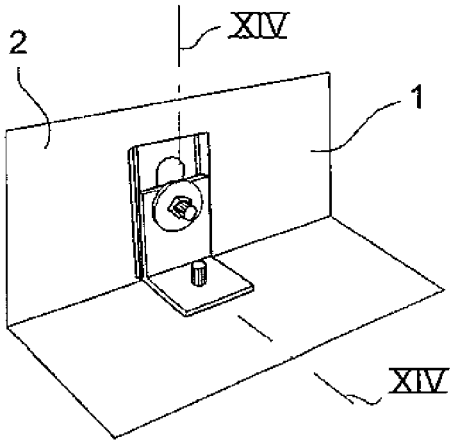
FIG. 13 is a perspective view of the connection zone (lower internal angle) between a wall element and a floor according to an embodiment.
Figure 14:
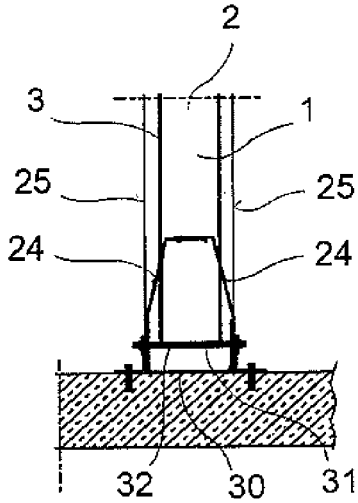
FIG. 14 is a sectional view according to plane XIV-XIV in FIG. 13.
Figure 15:
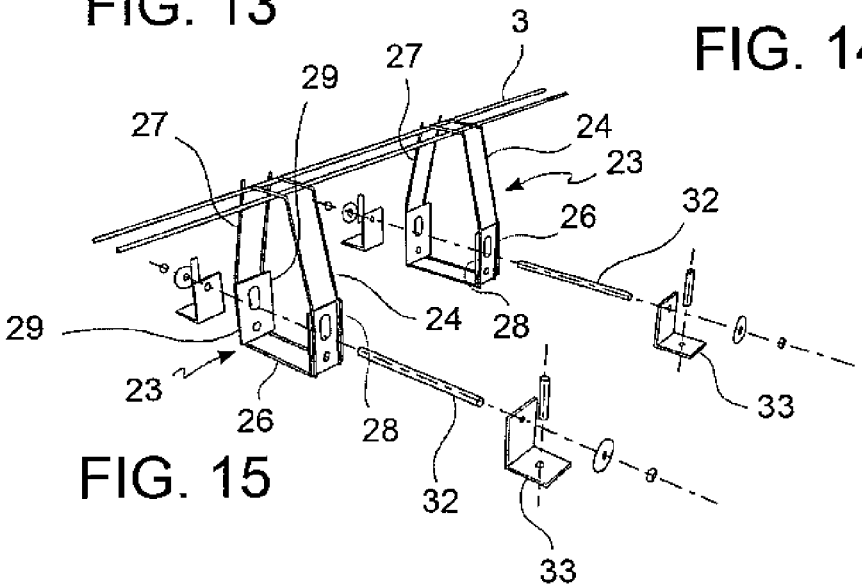
FIG. 15 is an exploded view of some details of FIGS. 13 and 14.
Figure 16:
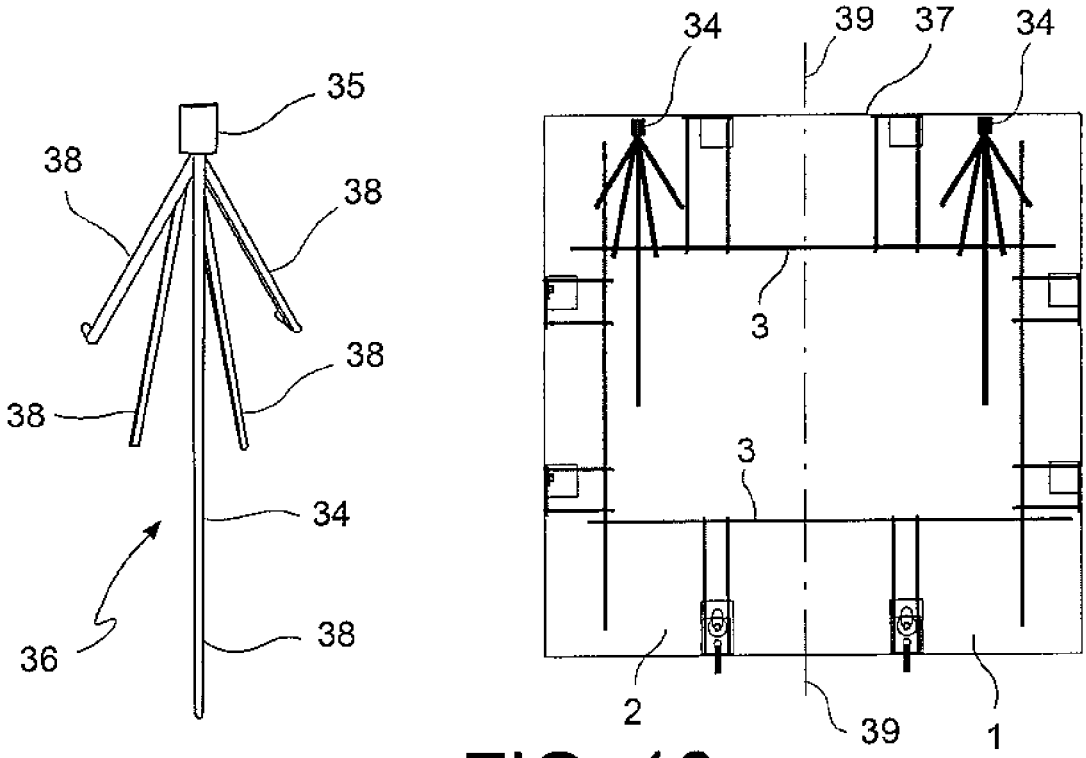
FIG. 16 is a transparent lateral view of a wall element (with the reinforcement meshes removed) according to an embodiment.
Figure 17:
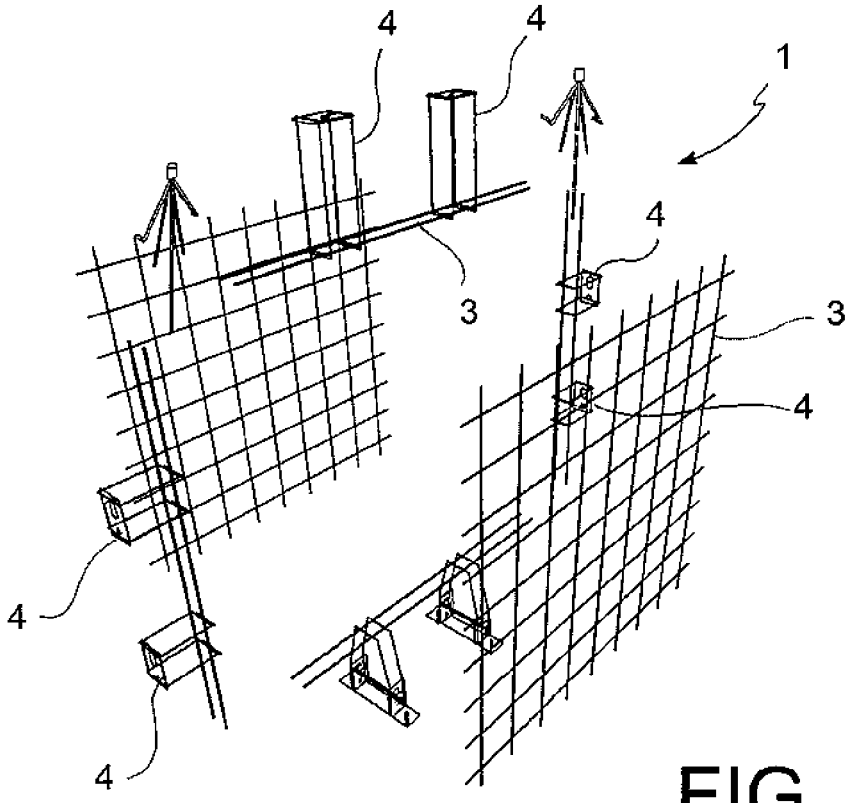
FIG. 17 is an exploded view of the reinforcement, of connection means and of engaging means for hoisting the wall element in FIG. 16.

The configuration of the positioning and connecting means described up to now, allows overcoming a local concentration of the stresses related to the connection of the wall elements 1 and one obtains an easy access to the assembling seat 9 so as to be able to insert the connecting bolts 12 FIG. 5 and position and screw the respective nuts.

Furthermore, the eyelet or elliptic eyelet form of the connecting holes 11 allows compensating—within given limits during mutual positioning and connection of the wall elements 1—the dimensional tolerances thereof and allows an accurate and safe positioning and connection without "invasive" interventions onto the body 2 of the wall element 1.

According to an embodiment of the invention, the anchoring brackets 6 comprise a closed ring bent metal rod and having a front portion 14 extended along a front surface 15

(facing outwards of the plate-like body 2) of the connecting plate 5, in such a manner that the plate 5 is wound by the anchoring bracket 6.

In order to ensure the correct relative positioning between the plate 5 and the anchoring brackets 6, the front portion 14 thereof is welded onto the front surface 15 of the connecting plate 5, preferably by means of external beads 16 formed on one side of the rod and a central bead 15 formed on the opposite side of the rod.

Advantageously, the anchoring brackets 6 are fixed to the connecting plate 5 near an upper 18 and lower 19 edge thereof and externally to a central zone 20 containing the connecting hole 11 and the hooking opening 13.

According to an embodiment, the metal reinforcement 3 comprises a plurality of groups of reinforcement rods 21 substantially extended parallel to the external edges 22 of the plate-like body 2, preferably at a distance from the external edges 22 comprised in the range between 10 cm to 60 cm, preferably from 25 cm to 55 cm, even more preferably at a distance of about 40 cm from the external edges 22. The anchoring brackets 6 are hooked or extended around such group of reinforcement rods 21 on the side remote from the connecting plates 5.

Figure 18:
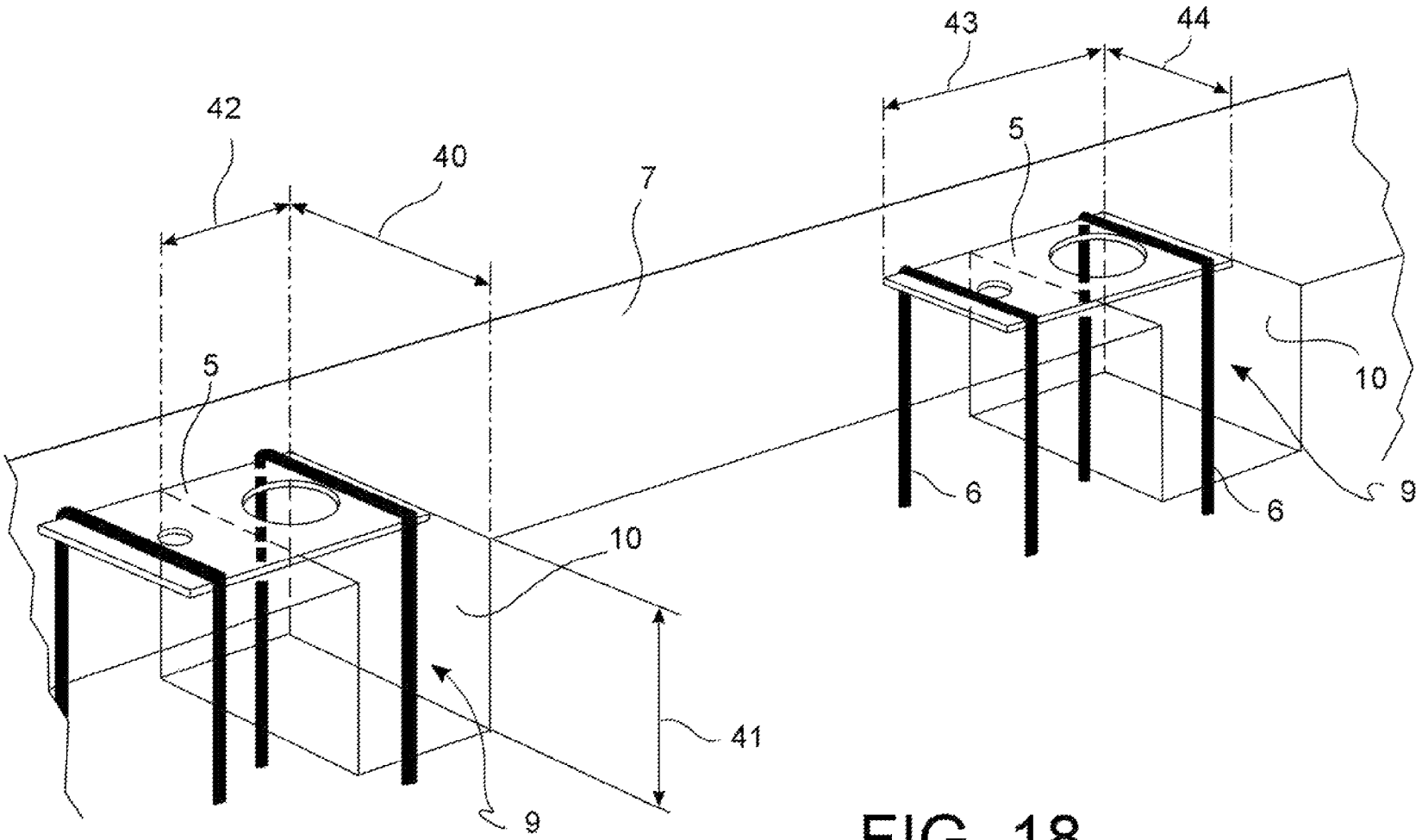
FIG. 18 is an enlargement of a portion of FIG. 1.

As shown in FIG. 18, the assembling seat 9 is parallelepiped-shaped, having a depth 41 perpendicular to the plane of the connecting plate 5, a longitudinal extension 40 parallel to the plane of the connecting plate 5 and a transverse extension 42 parallel to the plane of the connecting plate 5 and perpendicular to the longitudinal extension, in which the transverse extension and the depth are advantageously substantially equal and smaller than the longitudinal extensions, for example:

Depth=about 12 cm

Transverse extension=about 12 cm

Longitudinal extension=about 20 cm

Furthermore, the connecting plate 5 is preferably rectangular-shaped with a longitudinal extension 43 greater than the transverse extension 44, and it is positioned with respect to the assembling seat 9 in such a manner that the longitudinal extension 43 of the plate 5 is transverse (preferably perpendicular) to the longitudinal extension 40 of the assembling seat 9.

Given that the longitudinal extension of the connecting plate 5 is preferably greater than the transverse extension of the assembling seat 9, one or both ends of the plate 5 overlay the assembling seat 9 and at least one of the anchoring brackets is embedded in the body 2 substantially along the entire length (except for the front portion 14 thereof), see for example FIG. 1.

According to a further aspect of the present invention, the connecting plate 5, or the front surface 15 thereof is recessed with respect to the connection surface 7 of the plate-like body 1 in which the plate 5 itself is positioned. This allows making the connecting surfaces 7 of two wall elements 1 connected to each other adhere preferably at direct and pressing contact by fastening the connecting bolts 12.

This prevents unwanted gaps and interstices which would otherwise be filled and covered using plaster or other covering material. As far as the positioning and fixing of the wall element 1 on a floor or on a slab is concerned, there may be provided one or more, preferably two base plate-bracket units 23 with two parallel and opposite connecting plates 5, rigidly connected to at least one, preferably at least two base anchoring brackets 24, in which the connecting plates 5 are arranged in two external surfaces 25 of the plate-like body 2, adjacent and approximately perpendicular to a lower surface 26 thereof intended to lay on the slab or floor.

The base anchoring brackets 24 comprise a closed ring bent metal rod with a lower rectangular U-shaped portion 26 and an upper regular trapezium-shaped upper portion 27 with larger base facing downwards and connected to the lower portion 26.

The legs or sides 28 of the lower U-shaped portion are extended along the front surface 15 (facing outwards the plate-like body 2) of the connecting plate 5, so that the plate 5 is wound by the base anchoring bracket 24.

In order to ensure the correct relative positioning between the plate 5 and the base anchoring brackets 24, the portion 28 thereof is welded onto the front surface 15 of the connecting plate 5, preferably by means of two external beads formed on one side of the rod and a central bead formed on the opposite side of the rod.

Advantageously, the base anchoring brackets 24 are fixed, by welding, to the connecting plate 5 near the lateral edges 29 thereof and outside the central zone 20 containing the connecting hole 11 and the hooking opening 13.

Near the smaller base of the upper portion (trapezoidal) 27 of the base anchoring brackets 24 or, in other words, near the upper portion of the base anchoring brackets 24, the latter are hooked to or extended around a group of reinforcement rods 21 parallel to a lower edge 30 of the wall element 1.

Formed at the base plate-bracket units 23 is a through hole 31 in the plate-like body 2 which connects the connecting holes 11 of the two opposite connecting plates 5 in such a manner to allow the passage of a single long bolt 32 or threaded rod for connection with the external connecting members, for example corner sections 33 in turn anchored to the slab or on a floor.

According to a further embodiment, the wall element 1 may comprise one or more, preferably two hoisting hooks 34 with a hooking portion 35 arranged at a upper edge 37 of the wall element 1 and an anchoring portion 36 embedded in the cement wood of the plate-like body 2, in which the anchoring portion 36 comprises a plurality (preferably five) of anchoring arms 38 of different length and which are extended in different directions to facilitate a large distribution of the anchoring tensions in the cement-wood material of the plate-like body 2.

Advantageously, the hoisting hooks are arranged symmetrically with respect to a median axis 39 of the element 1.

The fabrication of the prefabricated wall element 1 may advantageously occur through the following steps:

- preparing the formwork;
- casting the first external finishing cement-wood layer;
- positioning a first reinforcement electrowelded mesh on the first external finishing layer;
- connecting the plate-bracket units to the first electrowelded mesh;
- casting a central wood-cement layer on the first electrowelded mesh;
- positioning a second electrowelded mesh on the central wood-cement layer;
- connecting the second electrowelded mesh to the plate-bracket units;
- casting a second external finishing wood-cement layer.

For providing the assembling seats, the following steps may be performed:

- positioning the caps made of excavatable material, e.g. polystyrene, at the rear of the connecting plates;
- after the hardening of the cement-wood, excavate the caps made of excavatable material.

After laying the prefabricated wall elements 1, the assembling seats 9 may be closed by means of special caps whose shape is complementary to the shape of the assembling seat itself or by means of expansion material, for example a polyurethane foam.

The wall elements 1 have various advantages. They are structurally simple and robust, easy to manufacture and allow an accurate and easy positioning as well as mutual connection without locally overstressing the cement-wood material.

Obviously, the prefabricated wall element according to the present invention may be subject—by a man skilled in the art with the aim of meeting contingent and specific requirements—to further modifications and variants, all falling within the scope of protection of the invention, as defined by the claims that follow.

What is claimed is:

1. A prefabricated wall element (1) comprising a plate-like body (2), a reinforcement (3) embedded in the body (2), and means (4, 5, 6) for the positioning and connection of the wall element (1) relative to further wall elements (1), wherein said means (4, 5, 6) comprises one or more plate-bracket units (4) each comprising a connecting plate (5) rigidly connected to one or more anchor brackets (6), said connecting plate (5) being arranged in a connecting surface (7), and said anchor bracket 6 being embedded in the plate-like body (2) and coupled to the reinforcement (3), wherein said plate-like body (2), together with a connecting plate (5) rear surface (8) inwardly facing the plate-like body (2), define an assembling seat (9) with an access opening (10) lateral to the connecting plate (5) and the connecting surface (7), wherein said assembling seat (9) has a parallelepiped shape having a depth which is perpendicular to the connecting plate (5) plane, a longitudinal extension which is parallel to the connecting plate (5) plane and a transverse extension parallel to the connecting plate (5) plane and perpendicular to the longitudinal extension, wherein the transverse extension is substantially equal to the depth and both the transverse extension and the depth are smaller than the longitudinal extension and said connecting plate (5) has a longitudinal extension which is greater than the assembling seat (9) transverse extension and which is located, relative to the assembling seat (9), so that:

the plate (5) longitudinal extension is transverse to the assembling seat (9) longitudinal extension;

at least one plate (5) end overtops the assembling seat (9);

at least one of the anchor brackets (6) is embedded in the body (2) substantially along the entire length thereof, except for the front portion (14) thereof.

2. The prefabricated wall element (1) according to claim 1, wherein the connecting plate (5) comprises one or more eyelet-shaped connecting holes (11).

3. The prefabricated wall element (1) according to claim 2, wherein said anchor brackets (6) comprise a metallic rod which is bent in the form of a closed ring or an open hook, and having a front portion (14) extending along a connecting plate (5) front surface (15) facing the plate-like body (2) exterior, so that the plate (5) is wrapped by the anchor bracket (6).

4. The prefabricated wall element (1) according to claim 3, wherein the anchor brackets (6) front portion (14) is welded on the connecting plate (5) front surface (15).

5. The prefabricated wall element (1) according to claim 4, wherein the anchor brackets (6) front portion (14) is welded on the connecting plate (5) front surface (15).

6. The prefabricated wall element (1) according to claim 1, wherein said anchor brackets (6) comprise a metallic rod which is bent in the form of a closed ring or an open hook, and having a front portion (14) extending along a connecting plate (5) front surface (15) facing the plate-like body (2) exterior, so that the plate (5) is wrapped by the anchor bracket (6).

7. The prefabricated wall element (1) according to claim 1, wherein the anchor brackets (6) are secured to the connecting plate (5), in the proximity of an upper (18) and lower (19) edge thereof, and externally to a central zone (20) containing the connecting hole (11).

8. The prefabricated wall element (1) according to claim 1, wherein said reinforcement (3) comprises a plurality of reinforcing rods (21) groups extending substantially parallel to the plate-like body (2) outer edges (22), and said anchor brackets (6) are coupled to said reinforcing rods (21) groups.

9. The prefabricated wall element (1) according to claim 1, wherein the connecting plate (5) front surface (15) is retracted relative to the plate-like body (2) connecting surface (7).

10. The prefabricated wall element (1) according to claim 9, wherein the leg (28) is welded on the connecting plate (5) front surface (15) in the proximity of lateral edges (29) thereof and externally to the central zone (20) containing the connecting hole (11).

11. The prefabricated wall element (1) according to claim 10, wherein said base anchor brackets (24) are coupled to a group of reinforcing rods (21) which is parallel to a wall element (1) lower edge (30).

12. The prefabricated wall element (1) according to claim 1, comprising one or more base plate-bracket units (23) with two parallel and opposite connecting plates (5), rigidly connected to one or more base anchor brackets (24), said connecting plates (5) being arranged in two outer surfaces (25) of the plate-like body (2), adjacent and approximately perpendicular to a lower surface (26) thereof, wherein said base anchor brackets (24) comprise a metallic rod which is bent in the form of a closed ring with a U-shaped lower portion (26) and a trapezoidal upper portion (27) with the major base facing downwardly and connected to the lower portion (26), wherein legs (28) of the U-shaped lower portion (26) extend along the front surface (15) facing the connecting plate (5) exterior, so that the plate (5) is wrapped by the base anchor bracket (24).

13. The prefabricated wall element (1) according to claim 12, wherein said base anchor brackets (24) are coupled to a group of reinforcing rods (21) which is parallel to a wall element (1) lower edge (30).

14. The prefabricated wall element (1) according to claim 12, wherein a through hole (31) in the plate-like body (2) connects the connecting holes (11) of the two opposite connecting plates (5) of the base plate-bracket unit (23) so as to receive a single long bolt (32) for the connection with external connecting elements.

15. The prefabricated wall element (1) according to claim 1, comprising two lifting hooks (34) with a coupling portion (35) which is arranged at a wall element (1) upper edge (37) and an anchor portion (36) embedded in the plate-like body (2), wherein the anchor portion (36) is a plurality of anchor arms (38) having different length extending in different directions.

* * * * *